US006349581B1

(12) United States Patent
Palzer et al.

(10) Patent No.: US 6,349,581 B1
(45) Date of Patent: Feb. 26, 2002

(54) METHOD FOR CONTROLLING THE TENSION BETWEEN ROLL STANDS OF MILL TRAINS FOR STEEL BARS, WIRE OR PROFILES

(75) Inventors: Otmar Palzer, Jüchen; Hubert Müller, Grevenbroich; Ulrich Svejkovsky, Wuppertal, all of (DE)

(73) Assignee: SMS Schloemann-Siemag AG, Düsseldorf (DE)

( * ) Notice: Subject to any disclaimer, the term of this patent is extended or adjusted under 35 U.S.C. 154(b) by 0 days.

(21) Appl. No.: 09/591,433

(22) Filed: Jun. 9, 2000

(30) Foreign Application Priority Data

Oct. 6, 1999 (DE) ..... 199 26 230
Feb. 18, 2000 (DE) ..... 100 073 369

(51) Int. Cl.[7] ..... B21B 37/48

(52) U.S. Cl. ..... 72/11.4; 72/8.6; 72/11.1; 72/37; 72/205

(58) Field of Search ..... 72/8.3, 8.6, 8.9, 72/11.1, 11.4, 11.6, 12.3, 37, 205, 365.2, 710

(56) References Cited

U.S. PATENT DOCUMENTS 5,784,914 A * 7/1998 Ciani ..... 72/8.6
5,996,384 A * 12/1999 Steeper et al. ..... 72/8.3
6,029,485 A * 2/2000 Bohmer ..... 72/8.3
6,199,417 B1 * 3/2000 Palzer et al. ..... 72/8.6

* cited by examiner

*Primary Examiner*—Ed Tolan
(74) *Attorney, Agent, or Firm*—Sidley Austin Brown & Wood, LLP

(57) ABSTRACT

Rolling stock is transported in a transporting device from a front roll stand to a rear roll stand. Between the roll stands, the rolling stock carries out an oscillation transverse to the transporting direction. At least one characteristic property, amplitude or frequency, of the oscillation is determined quantitatively and, from this determination, a tension or compression, existing in the rolling stock between the roll stands is determined. One of the roll stands is readjusted in such a manner, that a desired tension is built up in the rolling stock between the roll stands.

13 Claims, 4 Drawing Sheets

Figure 1:
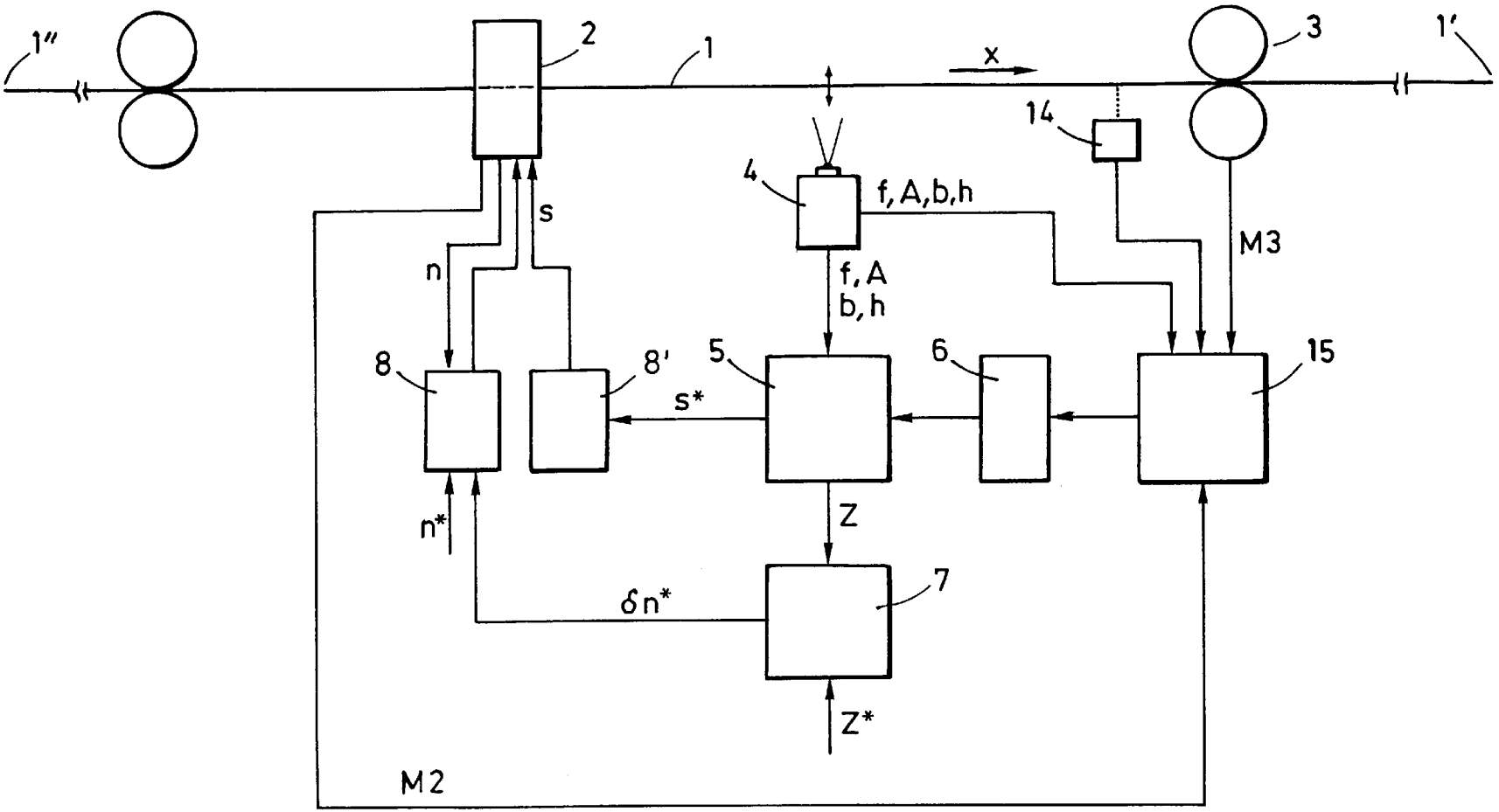

METHOD FOR CONTROLLING THE TENSION BETWEEN ROLL STANDS OF MILL TRAINS FOR STEEL BARS, WIRE OR PROFILES

The invention relates to a method for controlling the tension between the roll stands of mill trains for steel bars, wires or profiles by controlling the rotational speed of the driving mechanisms of consecutive roll stands.

Tensile and compressive forces affect the tolerances of the dimensions of the cross-section of rolling stock billets, as well as the uniformity of the course of the rolling process itself. An effective control of tension, by means of which, in particular, the build-up of compression in the rolling stock in the longitudinal direction is prevented, is therefore of great importance. Various methods of controlling the tension in the rolling plants have become known in the art. One method consists of calculating the quotient of rolling moment to rolling force and drawing a conclusion from this quotient concerning the tension existing in the rolling stock. Furthermore, a lead method is known, for which the speed differences between the rolling stock billets of consecutive supporting frameworks are evaluated. Additionally, loop controls are known, for which the height of the loop is a measure of the tension or compression in the rolling stock.

It is also known (German Offenlegungsschrift 1 602 020) that, in the case of two consecutive roll stands, values equivalent to the tension, such as the load current of the driving mechanism of roll stands, may be determined and compared with an empirical value and the thereby resulting deviations used for controlling the regulating and controlling devices of the driving mechanism of the subsequent, second roll stand. In a different method (DE 4 220 121), which works with only one comparison value and takes into consideration only one point of the load current profile of the driving mechanism of the roll stand, changes in the temperature structure cannot be detected over the length of the rolling stock and can therefore not be used for control purposes. A different proposal (German Offenlegungsschrift 2 448 033 and German patent 38 06 063) of using, as a regulating variable, the ratio of the armature current of the driving mechanism to the roll separating force, which results from the deformation in the roll gap and which is determined with the aid of load cells installed in the roll stand, did not gain acceptance in practice. This lack of acceptance is because the arrangement and reliability of the pressure measuring devices, especially their maintenance, was associated with difficulties, which have so far not been eliminated. A proposal to determine the load current of the downstream equipment and comparing it in each case with the determined and stored values from preceding supporting frameworks and forming a relative comparison value for control corrections also did not gain acceptance in practice.

It is an object of the invention to improve the generic method so that the tension control between the supporting frameworks of the mill train can be achieved with the help of simple, conventional commercial measurement and control devices disposed outside of the supporting framework.

This objective is accomplished due to the fact that, at least one characteristic of the oscillations, which the rod or wire carries out between two consecutive roll stands, is determined quantitatively and, by comparison with identification points of the oscillations, a tension or compression, existing in the rolling stock between the supporting frameworks, is determined and one of the roll stands is readjusted so that the desired tension builds up in the rolling stock between the roll stands.

As furthermore provided by the invention, an oscillation-determining device for the quantitative determination of at least one characteristic property of an oscillation of the rolling stock may be disposed between the roll stands transversely to a transporting device from the front to the rear roll stand and this detection device may be connected with a tension-determining device, by means of which a tension or compression, existing in the rolling stock between the roll stands, can be determined by a comparison of oscillation identification points.

The characteristic property of the oscillation may be the frequency and/or the amplitude of the oscillation. The readjustment of the roll stand can be accomplished, for example, by providing the readjusted roll stand with an additional desired rotational speed value (i.e., rpm) based on a difference between the existing tension or compression and the desired tension or compression.

If the characteristic property of the oscillation is determined by means of a camera device, which supplies at least one unidimensional dynamic image of the rolling stock transverse to the transporting device, then the determination of the characteristic property is particularly simple.

If the camera device supplies at least two, unidimensional dynamic images of the rolling stock transverse to the transporting device, wherein the images are recorded from different directions, then the oscillation can be determined independently of its plane of oscillation. A variation of the plane of oscillation may arise, particularly, in the case of rod-shaped rolling stock.

If, by means of the dynamic images, at least one dimension of the rolling stock is determined transversely to the transporting direction, an even better determination of the tension or compression, existing in the rolling stock between the roll stands is possible. Moreover, it is possible that, because of the fixed dimensions of the rolling stock, at least one control parameter of the front roll stand, especially a value or a roll gap value, is varied. In the case of rod-shaped rolling stock, the fixed dimension, preferably, is the width of the profile, since the width is more sensitive to tension than the height of the profile.

The camera device can more easily be moved out of the mill train if the camera device is disposed in a frame that can be moved as a unit.

The camera device can be operated more reliably if the frame is closed and there is excess pressure in its interior and the interior is.

Although the oscillation identification points can be determined theoretically, a gradual self-calibration is preferred.

The rolling stock has a point. The self-calibration therefore can take place, for example, due to the fact that

- after the point the rolling stock has entered the front roll stand and before it enters the rear roll stand, a front free moment, applied by the front roll stand, is determined,
- after the point of the rolling stock has entered the rear roll stand, a front tensile moment, applied by the front roll stand, is determined,
- a tension, existing in the rolling stock, is determined from a comparison of the front free moment and the front tensile moment and
- the tension and the characteristic property of the oscillation, measured at this tension, are stored as an identification point in a memory.

The rolling stock also has an end. The self-calibration can therefore also be accomplished due to the fact that

- after the rolling stock runs out of the supporting framework immediately ahead of the front roll stand and before it runs out of the front framework, a rear tensile moment, applied by the rear roll stand, is determined, after the end of the rolling stock runs out of the front roll stand, a rear free moment, applied by the rear roll stand, is determined, from a comparison of the rear free moment and the rear tensile moment, a tension, existing in the rolling stock, is determined and the tension and the characteristic property of the oscillation, measured at this tension, are stored as identification point in a memory.

If additionally a temperature, existing in the rolling stock, is also determined and stored, complete reproducible information concerning the identification point, related to the quality of the rolling stock, is available.

When rolling profiled rods, the invention makes provisions so that, between two consecutive supporting frameworks, the profile of the rod is measured with profile meters and the values of the respective flange widths, determined by these measurements, are compared in a computer with specified fixed values, for correcting the rpm regulating values of the subsequent supporting frameworks. The values of the flange width, determined by the profile meters, can be compared with values of flange widths, which were determined by further profile meters, upstream from the two roll stands. At the same time, the flange width of laser measuring equipment or line cameras, which determine profiles, can also be used.

Furthermore, when the measurement equipment is disposed in a compact roller group, consisting of a universal supporting framework at the inlet, an intermediate edger and a universal supporting framework at the outlet, a first measurement of the flange width of the rolling stock billet, entering the compact roller group, can be carried out between the universal supporting framework on the inlet side and the intermediate edger, before this profiled billet reaches the universal framework on the outlet side. This is then followed by a second measurement, when the universal supporting framework at the outlet side has taken hold of the profiled billet.

This procedure makes use of the changes in the dimensions of the cross section of the profile, which result from the tension acting on the profiled rod between the two roll stands. This change occurs particularly in the flange width of girders and similar profiles and can easily be accurately determined with the means given.

Figure 2:
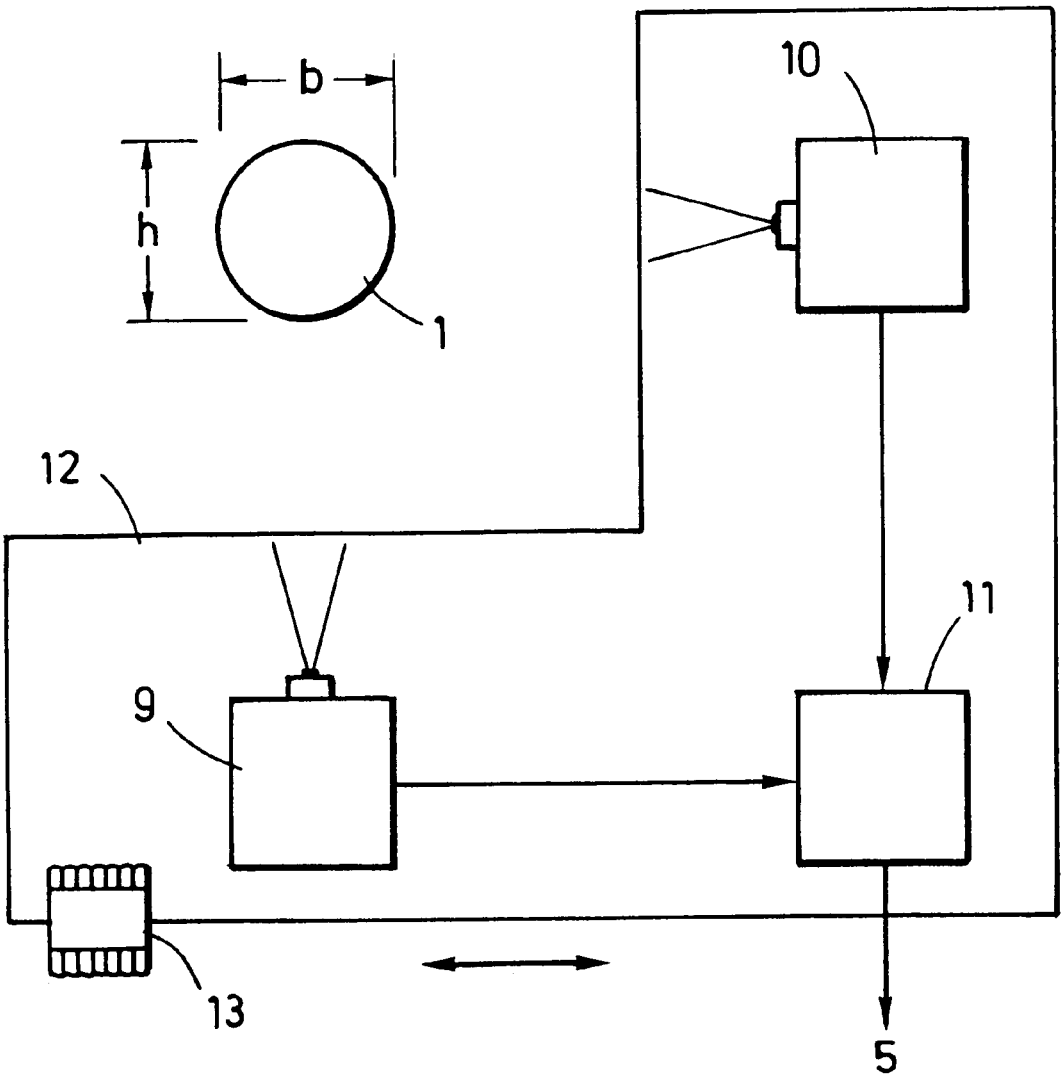
Figure 3:
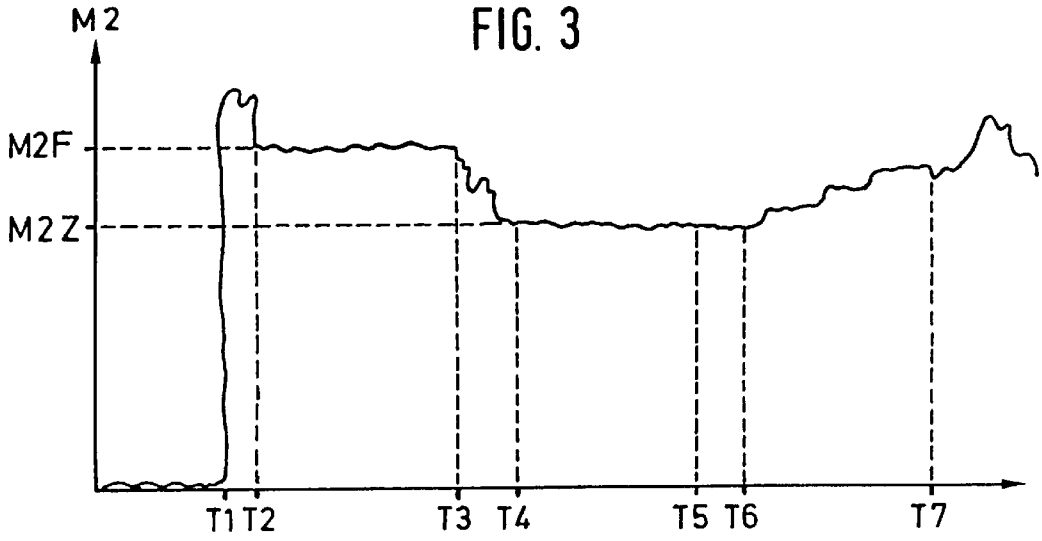
Figure 4:
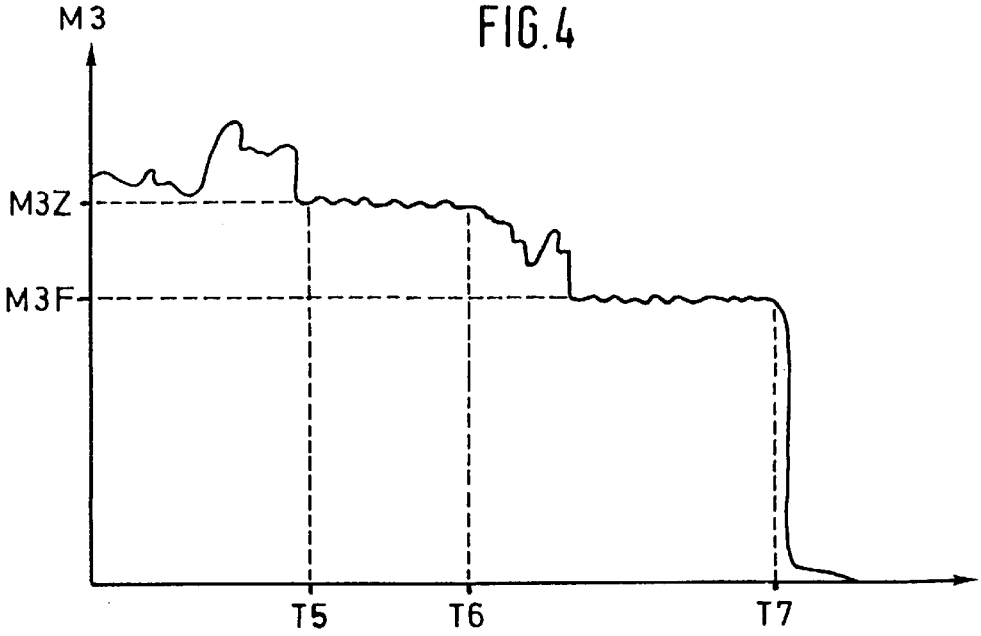
Figure 5:
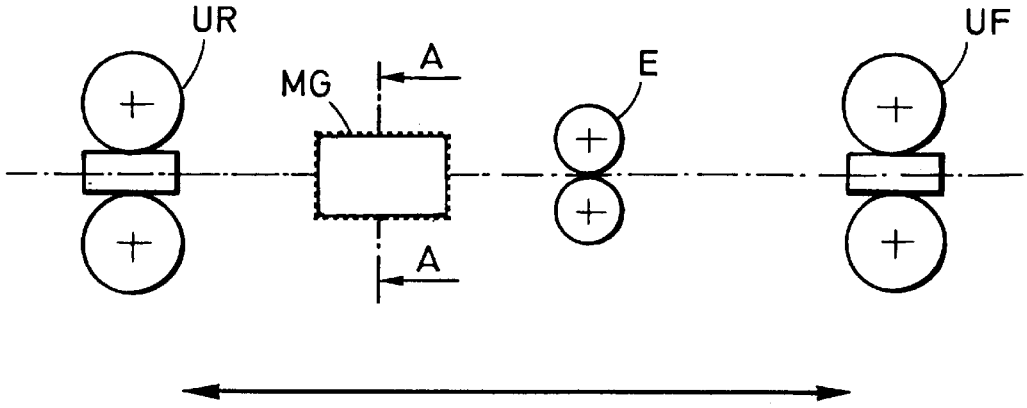
Figure 6:
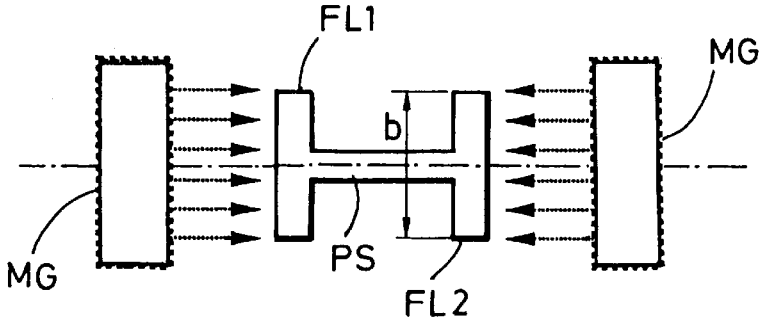

The inventions are explained in greater detail, for example, in the drawings, in which FIG. 1 shows a section of a mill train with several supporting frameworks, FIG. 2 shows a device for determining oscillation and the rolling stock the mill train has taken hold of, FIG. 3 shows a graph of the driving torque as a function of time, FIG. 4 shows another graph of the driving torque as a function of time, FIG. 5 shows a roll stand arrangement for rolling profiled rods and FIG. 6 shows a section along the line A—A of FIG. 5.

According to FIG. 1, a mill train for rolling stock 1 has a front roll stand 2 and a rear roll stand 3. The rolling stock is transported in a direction x from the front roll stand 2 to the rear roll stand 3. During this transport, the rolling stock 1 carries out an oscillation between the roll stands 2, 3 with an amplitude A and a frequency transverse to the direction of transportation.

As illustrated in FIG. 1, the front roll stand 2 is constructed as a vertical supporting framework, while the rear roll stand 3 is constructed as a horizontal framework. Therefore, a rod-shaped rolling stock 1, such as steel bars or wire, is rolled in the roll stands 2, 3. The rolling stock 1 could, however, also be a strip. The rolling stock 1 may consist of steel, copper, aluminum, brass or a different metal.

An oscillation detection device 4 is disposed between the roll stands 2, 3. The amplitude A and the frequency f of the oscillation, that is, the oscillation's characteristic properties, can be determined quantitatively by means of the oscillation-determining device 4.

The oscillation frequency f and amplitude A that were determined are supplied to a tension-determining device 5, with which the oscillation-determining device 4 is connected. The tension-determining device 5 compares the oscillation amplitude A and frequency f, which have been determined, with identification points, which are stored in a memory 6. From this comparison, the tension-determining device 5 determines a tension Z, which exists in the rolling stock 1. If the determined value of the tension Z is negative, there is a compression in the rolling stock 1.

The tension-determining device 5 supplies the tension Z to a tension control device 7, which is connected to it for control purposes. A desired tension $Z^*$ is furthermore supplied to the tension control device 7. On the basis of a difference between the tension Z and the desired tension $Z^*$, the tension control device 7 determines an additional rpm desired value $\delta n^*$, which it passes on to an rpm controlling device 8, which is connected to it for control purposes. Furthermore, a desired rpm $n^*$ and, an actual value, an rpm n, are supplied to the rpm control device 8. Because of a difference between the existing tension Z or compression and the desired tension $Z^*$, the front roll stand 2 is acted upon with the additional rpm desired value $\delta n^*$, so that the desired tension $Z^*$ builds up in the rolling stock 1 between the roll stands 2 and 3.

It is sufficient if only one characteristic property of the oscillation, that is, only the oscillation amplitude A or only the oscillation frequency f is determined. The determination of both properties A and f is, however, advantageous because a mutual plausibility testing of the two determined properties A and f is possible.

The oscillation-determining device 4, by means of which the characteristic property or properties A and f of the oscillation are determined, may be constructed for example, as a camera device 4. Conventional, commercial CCD cameras, for example, supply at least unidimensional dynamic images with a resolution of 5,000 pixels at an image frequency of 50 Hz. For many applications, this is adequate. Optionally, CCD cameras with higher image frequencies up to 2 kHz may also be used.

According to FIG. 2, the camera device has two cameras 9, 10, which are disposed in different image directions with respect to the rolling stock 1. The images, which the cameras 9,10 supply transverse to the transporting direction x, are therefore recorded from different directions. In a particular case, it may also be adequate, to use only one camera 9 or camera 10.

It is also possible to evaluate the images, recorded by the cameras 9, 10, in an evaluating device 11 with respect to the characteristic properties A and f of the oscillation. Preferably, however, the width b and height h of the rolling stock 1 are also determined. By means of the dynamic images, the dimensions h, b of the rolling stock 1 transverse to the transporting direction x are also determined. The tension Z, existing in the rolling stock 1, can also be determined from the dimensions h and b.

Typically, the evaluation of the frequency f of the oscillation is sufficient for determining the tension Z existing in the rolling stock 1. Especially when the tension Z or compression is very small, the amplitude A the oscillation assumes large values, so that the amplitude A can also be evaluated meaningfully when the tension Z is small and when there is compression.

The evaluation of the frequency f and of the amplitude A of the oscillation becomes unreliable, when the roll stands 2, 3 are operated with an rpm of n, which lies in the resonance frequency range of the rolling stock 1. Furthermore, because of the small amplitude A of the oscillation, the evaluation of the frequency f and the amplitude A of the oscillation is also unreliable, when the rolling stock 1 has a large cross section. In this case, however, the tension Z, existing in the rolling stock 1, can easily be determined by means of the width b.

Consequently, in spite of variable operating conditions, the tension Z, existing in the rolling stock 1, can always be determined reliably with only one sensor, namely the camera device 4, by means of the appropriately adapted evaluation of the signal supplied by the camera device 4.

Preferably, because of the fixed height h and the fixed width b of the rolling stock 1, at least one control parameter of the front roll stand 2 is also varied. For example, it is possible to vary the roll gap s correspondingly by specifying a new desired roll gap s*. For this purpose, the camera device 4 is connected with a roll gap-controlling device 8' for the front roll stand 2 for control purposes. The rpm of the front roll stand 2 can also be controlled on the basis of the dimensions h and b of the rolling stock 1, which had been determined.

According to FIG. 2, the camera device 4 is disposed in a closed frame 12. In the interior of the frame 12, there is an overpressure, so that contamination cannot reach the interior of the frame 12. Furthermore, the interior of the frame 12 is cooled by means of a cooling device 13, so that the components 9, 10, 11, disposed in the interior of the frame 12, work reliably. As indicated in FIG. 2 by a double arrow, the frame 12 can be moved as a unit out of the mill train. Accordingly, it is not necessary to dismantle the mill train.

The identification points, by means of which the tension Z is determined, can be determined initially and stored in the memory 6. It is, however, also possible to determine and/or to actualize the identification points experimentally. For the actualization, driving torques M2, M3 can be evaluated, which are applied by the front or rear roll stand 2, 3, in the starting phase and the phasing-out phase.

For example, the rolling stock 1 has a rolling stock point 1'. As long as the rolling stock point 1' is between the roll stands 2, 3, the rolling stock 1 is transported from the front roll stand 2 without tension to the rear roll stand 3. On the other hand, when the rolling stock point 1' has entered the rear roll stand 3, the rear roll stand 3 can exert the tension Z on the rolling stock section between the roll stands 2, 3.

According to FIG. 3, the rolling stock point 1' enters the roll stand 2 at time T1. This initial pass entry briefly causes a highly fluctuating driving torque M2 in the front roll stand 2. These strong fluctuations end at time T2. After this time T2, the driving torque M2, applied by the front roll stand 2, is determined several times, supplied to a computer 15 and averaged. This average value subsequently is referred to as free moment M2F.

At a time T3, the rolling stock point 1' enters the rear roll stand 3. Once again, large fluctuations of the driving torque M2, applied by the front roll stand 2, occur here. The large fluctuations end at time T4. After this time T4, the driving torque M2, applied by the front roll stand 2, is determined several times, supplied to the computer 15 and averaged. This new average value is referred to as the front tensile moment M2Z.

From a comparison of the front free moment M2F and the front tensile moment M2Z, the tension Z, existing in the rolling stock 1, can be determined by the computer 15.

Simultaneously with the measurement of the front tensile moment M2Z, the characteristic properties A and f of the oscillation of the rolling stock 1 are determined and supplied to the computer 15. Furthermore, the temperature T of the rolling stock is determined by a temperature-determination device 14 and supplied to the computer 15. The oscillation amplitude A, the oscillation frequency f, the width b, the height h, the temperature T and the tension Z are then combined by the computer 15 as an identification point and stored in the memory 6. Optionally, the dimensions of the rolling stock h and b can also be stored.

In a similar manner, the discharging of the rolling stock 1 can also be used to determine identification points.

According to FIG. 4, the rolling stock end 1' runs out of a supporting framework 2, which is directly ahead of the front roll stand 2, at a time T5. After this time T5, a driving torque M3, applied by the rear roll stand 3, is determined repeatedly, supplied to the computer 15 and averaged. The average value subsequently is referred to as the rear tensile moment M3Z.

This determination of the moment and the calculation of the average value are ended before the rolling stock end 1' leaves the front roll stand 2 at time T6. After the rolling stock end 1' leaves the front roll stand 2, the driving torque M3, applied by the rear roll stand 3, is determined once again several times, supplied to the computer 15 and averaged. This new average value subsequently is referred to as the rear free moment M3F. The determination and the formation of the average value are ended before a time T7, at which the rolling stock end 1" leaves the rear roll stand 3.

By comparing the rear free moment M3F and rear tensile moment M3Z, the tension Z in the rolling stock 1 between the roll stands 2, 3 can once again be determined. As before for the rolling stock point 1', the characteristic properties A, f of the oscillation, together with the dimensions h, b of the rolling stock 1 and the temperature T of the rolling stock 1, as well as the measured tension Z, are once again stored by the computer 15 as identification point in the memory 6.

A multitude of advantages can be achieved with the inventive tension control method and the herewith corresponding mill train. In particular, a continuous control of tension to a minimum tension is possible. The tension control can also be started in any rolling stock sections between two roll stands 2, 3. The dimensions h, b, determined for the rolling stock 1, can also be used for controlling the roll gap. Moreover, the determination of the rolling stock 1 as such can also be used for following the material flow. Finally, the tension control method can be implemented cost effectively and even existing mill trains can easily be retrofitted.

As is evident from FIGS. 5 and 6, the roll stand arrangement for rolling profiled rods, especially H beams, consists of a compact group of rollers, which has a universal supporting framework UR at the inlet side and a universal supporting framework UF at the outlet side, as well as an edger E between these. This compact group of rollers usually is operated reversibly. Between the universal supporting framework UR on the inlet side and the edger E, a measuring device MG is disposed, which (see FIG. 5) determines the height b of the two flanges FL1 and FL2, that is, the width of the flanges of the profiled rod PS from both sides. These values determined are passed on to a computer in a manner that is not shown.

What is claimed is:

1. A method for controlling the tension between the roll stands of mill trains for a rolling stock by controlling a rotational speed of driving mechanisms of consecutive roll stands, comprising the steps of:

quantitatively determining at least one property of oscillations that the rolling stock carries out between two consecutive roll stands;

determining at least one of a tension and compression existing in the rolling stock between the roll stands by comparing identification points of the oscillations;

readjusting one of the two roll stands so that a desired tension builds up in the rolling stock between the roll stands;

determining a front free moment applied by a front roll stand, at a point after the rolling stock has entered the front roll stand and before the rolling stock enters a rear roll stand;

determining a front tensile moment applied by the front roll stand, at a point after the rolling stock has entered the rear roll stand;

comparing the front free moment and the front tensile moment to determine a tension existing in the rolling stock;

measuring the at least one property of oscillations at this tension; and storing the tension and the at least one property as an identification point in a memory.

2. A method for controlling the tension between the roll stands of mill trains for a rolling stock by controlling a rotational speed of driving mechanisms of consecutive roll stands, comprising the steps of:

quantitatively determining at least one property of oscillations that the rolling stock carries out between two consecutive roll stands;

determining at least one of a tension and compression existing in the rolling stock between the roll stands by comparing identification points of the oscillations;

readjusting one of the two roll stands so that a desired tension builds up in the rolling stock between the roll stands;

determining a rear tensile moment applied by a rear roll stand, at a point after an end of the rolling stock has run out of a supporting framework immediately ahead of a front roll stand and before the end of the rolling stock has run out of the front roll stand;

determining a rear free moment applied by the rear roll stand, at a point after the end of the rolling stock has run out of the front roll stand;

determining a tension existing in the rolling stock by comparing the rear free moment and the rear tensile moment;

measuring the at least one property of oscillations at this tension; and storing the at least one property and the tension as an identification point in a memory.

3. The method of claim 2, further comprising the steps of determining a value of a temperature existing in the rolling stock and storing the temperature value in the memory.

4. A method for controlling the tension between roll stands of mill trains for a rolling stock by controlling a rotational speed of driving mechanisms of consecutive roll stands, comprising the steps of:

supplying at least one unidimensional dynamic image of the rolling stock from a camera device at right angles to a transporting direction;

quantitatively determining at least one property of the oscillations that the rolling stock carries out between two consecutive roll stands with the camera device;

determining at least one of a tension and compression existing in the rolling stock between the roll stands by comparing identification points of the oscillations; and readjusting one of the two roll stands so that a desired tension builds up in the rolling stock between the roll stands.

5. The method of claim 4, wherein the supplying step includes the step of supplying at least two unidimensional dynamic images of he rolling stock from the camera device at right angles to the transporting direction and recording the images from different directions.

6. The method of claim 5, further comprising the step of using the dynamic images to determine at least one dimension of the rolling stock transverse to the transporting direction.

7. The method of claim 6, further comprising the step of varying, on the basis of fixed dimensions of the rolling stock, at least one control parameter of a front roll stand selected and from the group consisting of a roll gap and a rotational speed.

8. A mill train for a rolling stock including a rod-shaped rolling stock selected from a group consisting of steel bars and wire comprising:

a front roll stand and a rear roll stand, a tension-determining device with a tension control device for the rolling stock being connected between the front and rear roll stands;

an oscillation-determining device for quantitative determination of at least one characteristic property of an oscillation of the rolling stock, which is located between the front and rear roll stands, in a direction transverse to a transporting direction from the front roll stand to the rear roll stand;

wherein the oscillation-determining device is connected to the tension-determining device;

wherein the tension-determining device determines at least one of a tension and a compression, which exists in the rolling stock between the roll stands, by a comparison with oscillation identification points; and wherein the oscillation-determining device is a camera device for supplying at least one unidimensional dynamic image of the rolling stock at right angles to the transporting direction.

9. The mill train of claim 8 wherein the camera device includes two cameras disposed in different directions with respect to the rolling stock.

10. The mill train of claim 9, wherein the camera device is connected with a control device for controlling the front roll stand.

11. The mill train of claim 10, wherein the camera device is disposed in a frame that is moveable as a unit.

12. The mill train of claim 11, wherein the frame is closed with an overpressure that exists in an interior of the frame, and wherein the interior is cooled.

13. The mill train of claim 12, wherein a temperature-determining device is disposed between the front roll stand and the rear roll stand.

* * * * *